United States Patent [19]

Stahlecker

[11] Patent Number: 4,471,901

[45] Date of Patent: Sep. 18, 1984

[54] CONTAINER CUT FROM A SINGLE PIECE OF MATERIAL

[75] Inventor: Hans Stahlecker, Süssen, Fed. Rep. of Germany

[73] Assignee: Michael Horauf Maschinenfabrik, Suessen, Fed. Rep. of Germany

[21] Appl. No.: 524,221

[22] Filed: Aug. 18, 1983

Related U.S. Application Data

[63] Continuation of Ser. No. 299,633, Sep. 4, 1981, abandoned.

[30] Foreign Application Priority Data

Jul. 17, 1981 [DE] Fed. Rep. of Germany ... 8120990[U]

[51] Int. Cl.[3] ..... B65D 5/24

[52] U.S. Cl. ..... 229/31 R; 229/1.5 B; 229/4.5; 229/DIG. 11

[58] Field of Search ..... 229/31 R, 32 R, 31 FB, 229/34 R, 1.5 B, 2.5 R, 45, DIG. 11

[56] References Cited

U.S. PATENT DOCUMENTS

| | | | |
|---|---|---|---|
| 3,401,862 | 9/1968 | Wanderer | 229/2.5 R |
| 3,531,041 | 9/1970 | Rohde | 229/34 |
| 3,532,250 | 10/1970 | Gay | 229/31 R |
| 3,606,078 | 9/1971 | Phillips | 229/31 R |
| 3,733,023 | 5/1973 | Arneson | 229/31 |
| 3,767,108 | 10/1973 | Arneson | 229/31 R |
| 3,927,893 | 12/1975 | Persson | 229/31 R |
| 4,008,848 | 2/1977 | Christenson | 229/31 R |
| 4,199,097 | 4/1980 | Christenson | 229/31 R |
| 4,253,602 | 3/1981 | Kulig | 229/31 R |
| 4,260,098 | 4/1981 | Mamizza | 229/31 R |

FOREIGN PATENT DOCUMENTS

| | | | |
|---|---|---|---|
| 226233 | 7/1943 | Switzerland | 229/31 R |

*Primary Examiner*—William Price
*Assistant Examiner*—Gary E. Elkins
*Attorney, Agent, or Firm*—Craig & Burns

[57] ABSTRACT

A container formed from a single cut of material, with a bottom of the container having a rectangular or square surface area and being bordered by prepared folding lines around which strips are folded open that connect to the bottom and form shell surfaces of the container. In each case two additional prepared folding lines are provided between the strips that extend at right angles to each other with the additional folding lines extending toward each other and enclosing an angle of less than 90° and deviating from the direction of the folding lines that border the bottom portion of the container so that areas of the strips that are located outside of the extension of the folding lines of the bottom portion are folded over and may be placed against the outside of the strip that was folded over. The shell surfaces are enclosed by a circular flanged roll which is formed by the edges of the folded open strip. Corners of the cut of material are recessed or notched in such a way that the edges intended for the flange roll at junction points only overlap along a short length in a circumferential direction of the flanged roll. A height and configuration or shape of the recesses or notches in the corners is selected so that a transistion of the flanged roll at the junction points of the edges to the shell surfaces has not cutting edges, and the flanged roll is formed of three layers.

8 Claims, 7 Drawing Figures

CONTAINER CUT FROM A SINGLE PIECE OF MATERIAL

This is a continuation of application Ser. No. 299,633, filed Sept. 4, 1981, now abandoned.

The present invention relates to a container construction and, more particularly, to a container or cup cut from a single piece of material such as cardboard, for example, or the like, with the material having a layer of heat-sealing material at least on portions thereof which form an interior surface of the container, wherein a bottom of the container has a rectangular or square surface area and is bordered by prepared folding lines around which strips are folded up that connect to the bottom and form outer shell surfaces of the cup.

Containers of the aforementioned type which are called paper or cardboard containers or cups may generally be manufactured in a simple and inexpensive manner. When the outer shell surfaces that are formed by the strips that connect to the bottom also pass over into each other in corner areas without interruptions, it can be ensured that a complete liquid tightness or sealing of the containers or cups may be achieved. If the areas that protrude at the corners of the blank of material are folded in such a manner that they rest against the outside of the outer shell surfaces, all cut edges of the container or cup blank are located outside of the area that comes in contact with a filled-in liquid. The provision of a rolled-over flanged rim results in an increased stiffness; however, care must be taken to make certain that an accumulation of material in the flanged rim is not excessive since otherwise it becomes difficult to make the flanged rim.

The aim underlying the present invention essentially resides in so constructing the container that no cut edges of the material blank are present also within the area of the flanged rim which are located within the area to be subsequently occupied by the filled-in liquid without the presence of excessive material accumulations within the area of the flanged rim. The underlying problems are solved according to the present invention in that cutouts are provided in the corners of the blank whose height and shape are so selected that the transition of the flanged rim at the butting places of the edges into the outer shell surfaces is devoid of any cut edges and is three-layered.

In an advantageous construction of the present invention, provision is made that the edges of the folded-up strips are formed into a rolled-up rim of spiral cross section. A further increase of the stiffness is achieved therewith since the material cross section is larger. It is thereby particularly advantageous if the flanged spirally shaped rim is pressed together into a flange extending parallel to the bottom portion and is heat-sealed. In addition to the increased stiffness, this flange entails the advantage that lids, lid foils or other closing devices may be easily installed thereon.

Advantageously in accordance with further features of the present invention, it is expedient to attach, in an area of the corners, corrugations for stacking which face toward the outside and which are located outside of the prepared folding lines bordering the bottom portion of the container.

Accordingly, it is an object of the present invention to provide a container or cup cut from a single piece of material which avoids, by simple means, shortcomings and disadvantages encountered in the prior art.

A further object of the present invention resides in providing a container or cup cut from a single piece of material which may be manufactured in a simple and inexpensive manner.

Yet another object of the present invention resides in providing a container or cup cut or formed from one piece of material which is provided with a flanged roll or rim to increase the stiffness of a portion of the container or cup.

These and other objects, features and advantages of the present invention will become more apparent from the following description when taken in connection with the accompanying drawings which show, for the purposes of illustration only, several embodiment in accordance with the present invention, and wherein.

Figure 1:
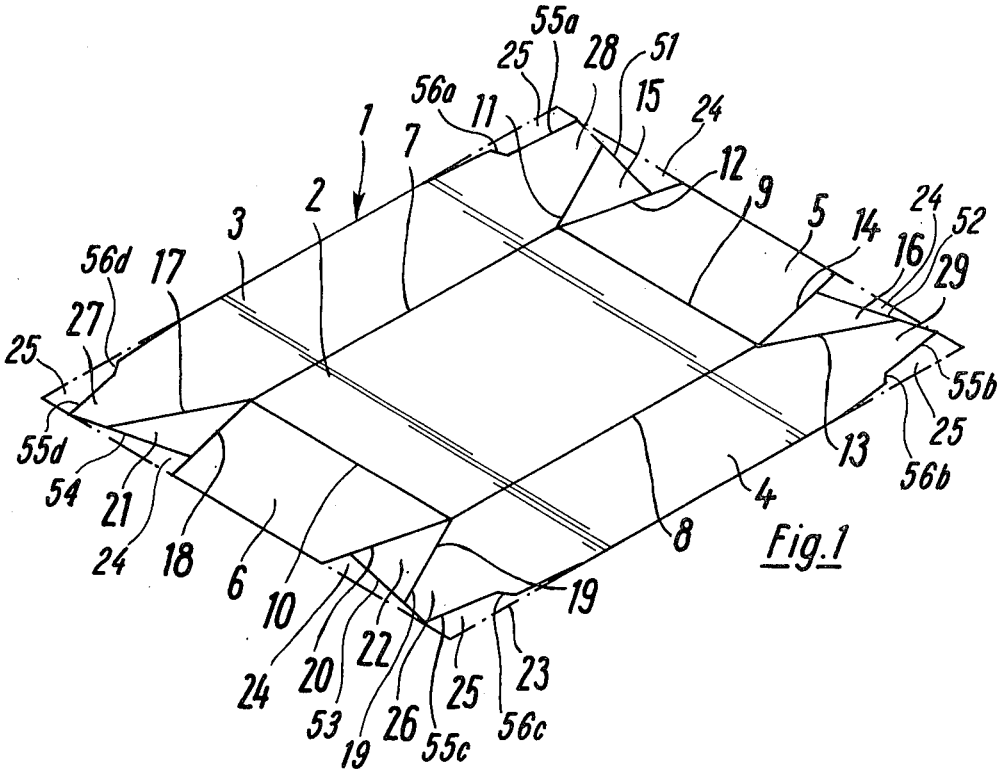
FIG. 1 is a perspective view of a cut or blank of a single flat piece of material for a cup or container of the present invention prior to a folding of the material.

Referring now to the drawings wherein like reference numerals are used throughout the various views to designate like parts and, more particularly, to FIG. 1, according to this figure, a flat cut or blank generally designated by the reference numeral 1 of material such as, for example, cardboard is provided, which may have a coating of polyethylene, polyester, polypropylene, or other synthetic materials. Additionally, a single or multiple lining with aluminum may be provided and, it is also possible to use combinations of aluminum/synthetic materials or to use partial-covered cardboard. However, it is advantageous in every case with regard to the manufacturing of the container or cup if the portion thereof which will eventually constitute the interior surface of the container or cup be coated with a heat sealing material.

The cut 1 includes a rectangular bottom 2 which is bounded or bordered by folding lines 7, 8, 9, 10, about which the strips that form the outer shell surfaces 3, 4, 5 and 6 are folded up. Additionally, the cut or blank 1 is provided with other folding lines or edges 11, 12, 13, 14, 17, 18, 19 20, which form intermediate pieces 15, 16, 21, 22 in the shape of a triangle which, in the finished cup or container, are located to the outside and are covered from the outside by the extensions 26, 27, 28, 29 of the strips forming the outer shell surfaces 3 and 4.

By heat-sealing the corner areas of the container or cup it is possible to achieve, on the one hand, that at the corners of the container or cup no notches or cuts extending to the bottom of the cup are provided but that the outer shell surfaces 3, 4, 5 and 6 are connected with each other also on their side edges by outer shell surfaces, namely, the intermediate pieces 15, 16, 21, 22. On the other hand, it is also achieved that at no place of the container or cup any cut edges occur on the inside of the cup or container.

As shown in FIG. 1, the original cut or blank 1 has a rectangular shape illustrated in phantom lines designated 23. For the purpose of folding the cup or container, cut-outs or recesses 24, 25 are punched out of the rectangular shape 23 in the area of each corner of the blank 1, as shown in the area of each corner (FIG. 1). The cut-outs or recesses 24, 25 also ensure that the rolled-over flanged rim, to be described hereinbelow, on the one hand, does not comprise an excessive material accumulation but that, on the other hand, no open cut edges, especially the outer ends of the folding lines 20 are located in the area which will subsequently be occupied by a liquid in the cup or container.

Figure 2:
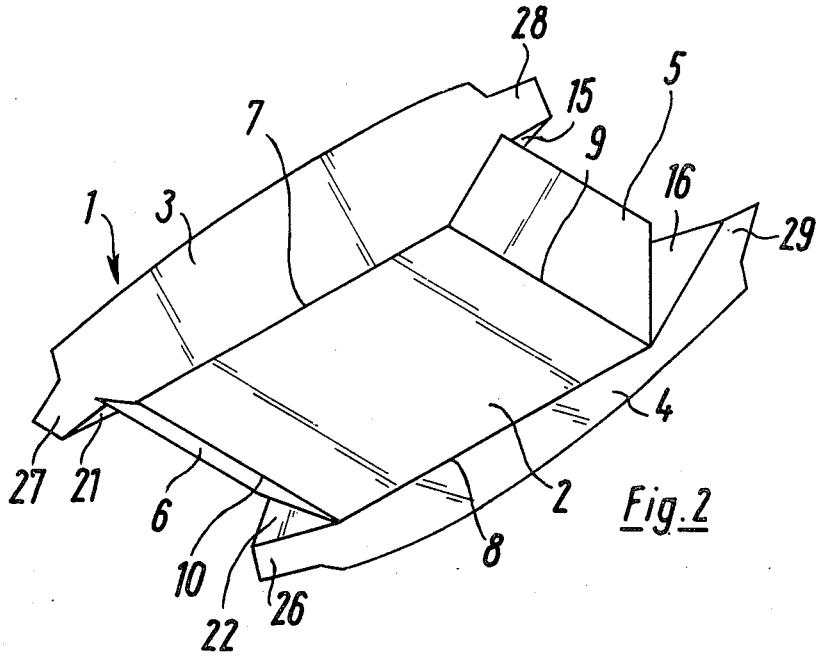
FIG. 2 is a perspective view of the blank of FIG. 1 after the beginning of the folding operation.

FIG. 2 shows the cut or blank 1 shortly after the beginning of the erection or folding up of the strips along the individual folding lines but prior to the completion of the folding process. As can be seen in FIG. 2, the outer shell surfaces 3 and 4 are folded up slightly along the bottom folding lines 7 and 8 and the outer shell surfaces 5 and 6, located on the future narrow sides of the container, are folded up slightly along the bottom folding lines 9 and 10. It can also be seen that the triangular intermediate pieces 15, 16, 21, 22 come to lie at the outside of the outer shell surfaces of the cup or container where they are later covered by the extensions 26, 27, 28, 29. This is achieved in that the third side 51, 52, 53 and 54 of each triangle 15, 16, 22 and 21, respectively, is formed by a generally rectilinear cut in cut-out 24 which starts from the respective extension 28, 29, 26 and 27 obliquely toward the respective bottom fold line 9 and 10 in such a manner that it intersects the corresponding further fold line 12, 14, 20 and 18 nearer the corresponding bottom fold line 9 and 10 than the further fold line 11, 13, 19, 17, and in that the cut-out 25 in each corner area is formed by a cut 55*a*, 55*b*, 55*c* and 55*d* preceded by a step-like cut 56*a*, 56*b*, 56*c* and 56*d* in such a manner that the free end of each extensions 28, 29, 26 and 27 is of reduced width. As shown in FIG. 1, the step-like cut 56*a*, 56*b*, 56*c* and 56*d* may also be preceded by a small cut approximately parallel to cut 55*a*, 55*b*, 55*c* and 55*d*.

Figure 3:
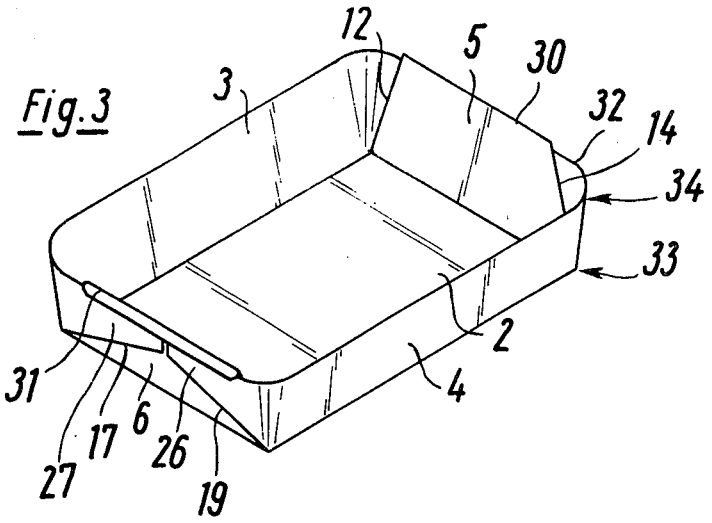
FIG. 3 is a perspective view of the container or cup of FIG. 1 in a folded-up condition.

FIG. 3 illustrates the erected or folded up container or cup after a folding but prior to the provision of a flanged rim and of stacking corrugations thereon. Preferably, the coating of the cardboard is heat sealable so that in the condition of FIG. 3, the folded container or cup after a heating can be repressed and sealed. In the bottom area, the container or cup has relatively sharp-edged corners generally designed by the reference numeral 33 and at the top, it has corners generally designated by the reference numeral 34 that are rounded off. As a result thereof, a shape widening towards the top of the container or cup is achieved which makes it possible to stack the containers after the subsequent provision of the stacking corrugations. All cut edges of the blank 1 are located on the outside of the container or cup so that no cuts or notches exist around the entire outer surface of the container. As a result thereof, the container or cup construction becomes absolutely tight, for example, with respect to liquids and grease. The outer shell surfaces 5 and 6 along the narrow sides of the container or cup, continue to protrude slightly with their associated edges 30 and 31 relative to the upper edge 32 of the container or cup.

In order to ensure that, on the one hand, no open cut edges come to lie on the inside of the container or cup also within the area of the further folding lines 12, 14, 18 and 20, the depth of the cut-outs 24 in the direction of these folding lines 12, 14, 18 and 20 is of significance. This depth must only go so far that the resulting open cut edge formed thereby is located in the starting area of the flanged rim 35 to be subsequently formed, that is, approximately at the upper edge 32 of the container. The cut-out 24 is thereby matched to the cut-out 25 in such a manner that the start of the flanged rim 35, that is, the transition to the outer shell surfaces 5 and 6 is only three-layered at the very start within the area of the butting places of the edges and then changes over into a two-layered construction.

Figure 4:
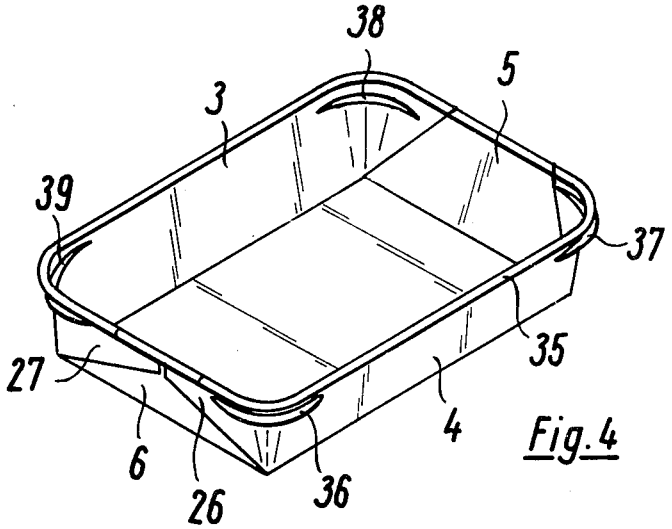
FIG. 4 is a perspective view of a finished container or cup after the provision of a flanged rolled-over rim and stacking corrugations.

FIG. 4 illustrates a finished container or cup which is additionally provided with a rolled-up flanged rim 35, to be more fully described hereinafter, around the upper edge as well as with corrugations 36, 37, 38 and 39 in the corner areas so as to facilitate stacking of the cups or containers. These stacking corrugations 36, 37, 38 and 39 are provided in such a manner that they do not cross the folding lines 12, 14, 18 and 20 (see also FIG. 1) because otherwise the material of the blank 1, for example, the cardboard material, might be damaged at these points.

Figure 5:
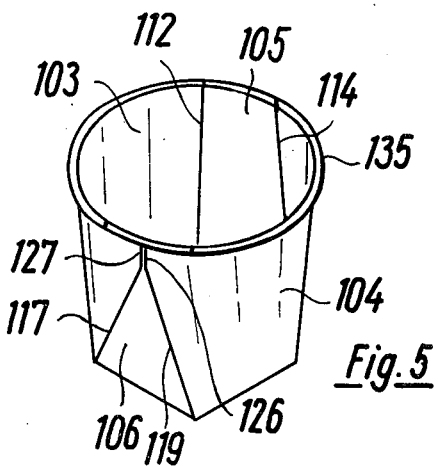
FIG. 5 is a perspective view of another embodiment of a container or cup constructed in accordance with the present invention.

It can be seen from FIG. 5 that the blank, for example, of cardboard may also be of square configuration. The container or cup of FIG. 5 is especially advantageous in the manufacture of folded containers for accommodating, for example, yogurt. The already finished container or cup is illustrated in FIG. 5, which is provided with a rolled-over flanged rim 135 as well as with outer shell surfaces 103, 104, 105 and 106. The folding lines 117 and 119 are located on the outside of the outer shell surfaces and do not come in contact with the liquid material to be subsequently placed into the cup or container. The folding lines 112 and 114 which are located on the inside of the outer shell surfaces are not harmful and pose no particular problems. By skillful printing on the previously flat container blank of FIG. 5, it can be achieved that the folding lines 117 and 119, located on the outside of the container or cup, are practically invisible.

Figure 6:
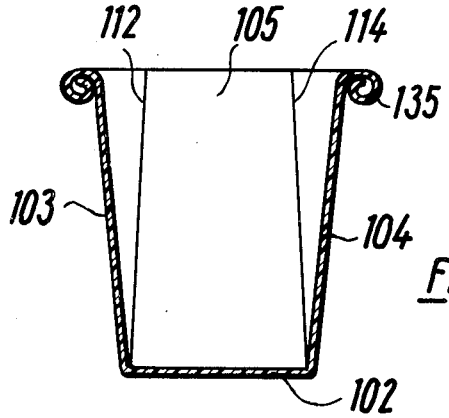
FIG. 6 is a longitudinal cross sectional view of the container or cup of FIG. 5.
Figure 7:
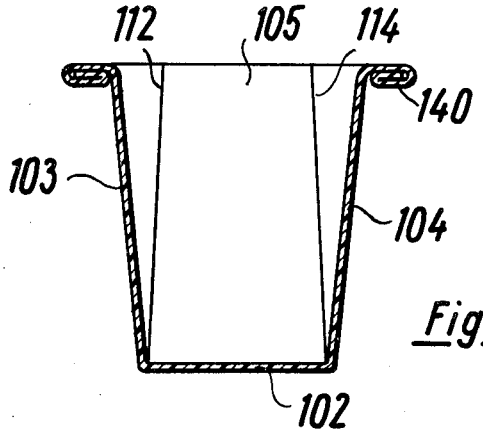
FIG. 7 is a cross sectional view of a cup or container similar to FIG. 5 but with a flanged rim in which a spirally shaped rim of FIG. 6 is pressed flat.

In order that the finished container or cup is particularly rigid and stiff with a flanged rim pressed flat, provision is made as shown in FIG. 7 that the flanged rim 140 is only three-layered. This is realized by a corresponding deformation of the flanged rim 135, not yet pressed flat (FIG. 6) which is rolled up spirally shaped.

FIG. 6 shows a cross section through the completely folded container or cup of FIG. 5, namely, in its position in which the outer shell surface 105 is visible. The container or cup of this embodiment has a square flat bottom portion 102 which passes over into the outer shell surfaces 103 and 104, shown in cross section in FIG. 6. A spirally rolled-up flanged rim 135 is formed-on in the upper area of the container or cup, by means of which the sides of the container or cup become more stable even when using relatively thin cardboard.

The container or cup of FIG. 7 differs from the container or cup of FIG. 5 only in that instead of the flanged rim 135, a rim 140 is provided which is pressed flat. For this purpose, the flanged rim 135 of FIG. 6 is acted upon by hot air and is subsequently pressed flat, i.e., the flat pressed rim 140 is produced by a subsequent deformation of the flanged rim 135 and is heat-sealed. For sealing the individual layers of the flat-pressed flanged rim 140, also high-frequency or ultrasonic systems may be used instead of the process using hot air.

While I have shown and described several embodiments in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A fluid-tight container made from a single blank which has four corner portions and is coated at least on its interior surface with a layer of heat-sealing material, said container including a bottom portion of rectangular configuration and delimited by bottom fold lines, strips which adjoin the bottom portion and which in the as-cut condition of the blank extend at substantially right angle to each other, being folded up about said bottom fold lines to thereby form the outer shell surfaces of the container, one pair of opposite strips having extensions at each end outside the areas of said bottom fold lines, two further fold lines each between respective adjacent strips which define two sides of a triangle and subtend an angle therebetween less than 90°, extending in directions different from the directions of the bottom fold lines so that said extensions can be folded over and placed against the outside of the other pair of folded-up strips, the further fold line of the two further fold lines of a respective triangle, which borders an adjacent one of the other pair of strips, forming an acute angle with the bottom fold line of the corresponding strip of said other pair of strips, the third side of each triangle being formed by one side of a generally triangularly shaped cut-out of a respective corner area, the third side of each triangle extending from the one of the two sides of said triangle which is nearer the adjacent extensions toward the other of said two sides in such a manner that it intersects the other of said two sides nearer the bottom fold line of the adjoining strip, a peripheral continuous flanged rim of substantially uniform configuration bordering the outer shell surfaces of the container, said flanged rim being formed by the edge portions of said folded-up strips, each corner area of the blank being additionally provided with another approximately triangularly shaped cut-out generally disposed at right angle to a corresponding first-mentioned cut-out of the same corner area and of such shape that the respective extension becomes narrower in the direction toward its free end, the depth of each first-mentioned cut-out at the point of intersection of the third side of a respective triangle with the other of said two sides being such that the open cut edge formed thereby lies within the starting area of the flanged rim, said cut-outs having such a height and configuration that all cut edges of the blank formed by the cut-outs are located on the outside of the container, and the first-mentioned cut-outs are thereby so matched to the second-mentioned cut-outs that the beginning of the flanged rim within the area of its transition into the surface of the other pair of strips, is three-layered only over a short distance and then becomes two-layered to assure a flanged rim of substantially uniform configuration to which a cover can be attached.

2. A container according to claim 1, wherein said blank is made from cardboard material.

3. A container according to claim 1, which forms a fluid-tight cup-like structure of square configuration in the bottom portion and substantially circular configuration at the top within the area of its edges.

4. A container according to claim 2, wherein the flanged rim is rolled-up in a spiral cross section.

5. A container according to claim 4, wherein the flanged rim of spiral cross section is pressed together into a rim having a surface parallel to the bottom portion of the container and is heat-sealed.

6. A container according to one of claims 1, 2, 4, or 5, wherein means are provided in the corner areas of the containers for facilitating a stacking of containers, said last-mentioned means being arranged outside of the bottom folding lines.

7. A container according to claim 6, wherein the means for facilitating stacking are formed by corrugations provided in the corner areas of the container.

8. A container according to claim 6, characterized in that the bottom portion of the container has a square configuration.

* * * * *